United States Patent [19]

Percoco et al.

[11] Patent Number: 4,887,856

[45] Date of Patent: Dec. 19, 1989

[54] LOCK MOUNTING ASSEMBLY

[75] Inventors: Stephen L. Percoco, Hull, Mass.; Jane M. Percoco, 41 Prospect Ave., Hull, Mass. 02045

[73] Assignees: Ann M. Percoco; Jane M. Percoco, both of Hull, Mass.

[21] Appl. No.: 378,046

[22] Filed: Jul. 11, 1989

Related U.S. Application Data

[63] Continuation of Ser. No. 155,145, Feb. 11, 1988, abandoned.

[51] Int. Cl.[4] ..... E05B 9/00

[52] U.S. Cl. ..... 292/337; 292/264; 292/DIG. 53; 292/3; 70/451; 70/DIG. 63

[58] Field of Search ..... 70/451, DIG. 63, 448, 70/450, 452, 451; 292/264, DIG. 53, 356, 357, 337, 3, 340

[56] References Cited

U.S. PATENT DOCUMENTS

| | | | |
|---|---|---|---|
| 399,239 | 3/1889 | Burgess | 70/448 |
| 571,027 | 11/1896 | Taylor | 70/448 |
| 1,423,825 | 7/1922 | Anderson | 70/451 |
| 1,483,333 | 2/1924 | Capelr | 70/451 |
| 1,924,627 | 8/1933 | Segal | 292/264 |
| 1,946,551 | 2/1934 | Smith et al. | 292/264 |
| 2,178,132 | 10/1939 | Anderson | 70/450 |
| 2,683,054 | 7/1954 | Earman | 292/340 |
| 2,696,728 | 12/1954 | Jewett et al. | 70/448 |
| 2,981,090 | 4/1961 | Patriquin et al. | 292/264 |
| 3,665,737 | 5/1972 | Reese | 70/DIG. 63 |
| 4,033,157 | 7/1977 | Williams | 70/DIG. 63 |
| 4,195,870 | 4/1980 | Percoco | 292/340 |

FOREIGN PATENT DOCUMENTS

| | | | |
|---|---|---|---|
| 19080 | 10/1895 | United Kingdom | 70/450 |
| 16818 | 10/1898 | United Kingdom | 70/452 |

*Primary Examiner*—Gary L. Smith
*Assistant Examiner*—Eric K. Nicholson
*Attorney, Agent, or Firm*—Hamilton, Brook, Smith & Reynolds

[57] ABSTRACT

A lock assembly comprising an L-shaped member (30) (120) having a first plate (32) (124) and a second plate (34) (122). Secured within the L-shaped member is a solid block core (50) (140) with openings (54) (64) (74) (90) (146) for receiving portions of lock hardware.

7 Claims, 5 Drawing Sheets

6
4
5
4
6
10
24
26
28
20
2
8
12
14
16
18
22

LOCK MOUNTING ASSEMBLY

This application is a continuation, of application Ser. No. 155,145, filed Feb. 11, 1988, now abandoned, the contents of which are hereby incorporated by reference.

FIELD OF THE INVENTION

This invention relates to locks in general, and more particularly to lock assembly mechanisms for mounting locks or lock hardwear in doors and door frames.

BACKGROUND OF THE INVENTION

The art is replete with inventions relating to locks of one type or another. Locks date back centuries with thousands of specialty locks developed for one purpose or another.

Locks for use in current-day residential structures generally include, inter alia, keyed cylinder locks, keyed deadbolt locks, slidebolts, chain locks, etc. Locks of these types are readily obtainable in hardware and building supply stores for installation in doors and door frames.

However, as a chain is no stronger than its weakest link, a lock is no better than its mounting assembly. A locking device which can be removed from a door or door frame without unlocking it is, practically speaking, worthless.

One of the objects of this invention is to provide a lock assembly for mounting lock hardwear in doors and door members which hardwear, per se, may be readily obtained commercially.

Another object of this invention is to provide a lock mounting assembly which is strong, reliable and universally adaptable to receive commercial hardware.

SUMMARY OF THE INVENTION

The invention resides in a lock mounting assembly which is applicable to both mounting assembly for securing hardware to doors and to striker assemblies for accommodation in door frames. The assembly comprises an L-shaped member which has a first plate and a second plate forming a right angle therewith. In the case of lock hardware mounting assemblies for doors, the first plate is called an edge plate and the second plate is called the front plate. In the case of a striker assembly, the first plate is also called the edge plate and the second plate is called the interior plate.

The first or edge plate is engageable with a vertical edge portion of a door, per se, or door member which is an edge portion of a door frame. The second plate or front plate in the case of a door assembly, or the interior plate in the case of a striker assembly, is engageable with a portion of the door or frame which is normal to the edge portion.

A solid block is secured, for example, by welding to the inside of the L-shaped member and forms an integral core thereof. The block itself is engageable within a recess in the door or frame which collectively are called door members.

A third plate which is substantially parallel to the second plate is releasably secured to the solid block. In the case of the lock hardware mounting assembly, it is called a cover plate and it is engageable with the inside of the door and is releasably secured to the solid block core by screws or the like. In the case of the striker assembly, the plate itself is the striker plate and is also releasably secured to the solid block core by screws or the like.

There is at least one opening in the solid block core which communicates with a mating opening in the first plate to accommodate a portion of lock hardware. In the case of the lock assembly, the opening would accommodate a key cylinder or a key deadbolt or the like. In the case of the striker assembly, the opening would accommodate the striker of the lock, a deadbolt or a slidebolt, etc.

In the case of the lock hardware mounting assembly, there are counter bores in the core leading to the edge plate to accommodate the striker, the deadbolt or slidebolt, etc. The solid block core is also formed with an opening to receive the head of a chain lock.

Fasteners pass through the cover plate or the striker plate, per se, and are received within the solid block core to hold the plates in position. The striker plate itself includes a beveled shoulder which is the first portion of the plate to be engaged by the lock striker.

The solid block core is preferably made of metal. It is secured, preferably by welding, to the second plate or the interior plate in the case of the striker assembly. The cover plate of the lock mounting assembly is secured by screws directly to the solid block core. The plate, being slightly larger than an opening in the door which receives the lock mounting assembly, is drawn with pressure against the door to hold the elements in position.

One of the features of the invention is that the front plate of lock mounting mechanism, i.e., that which faces the outside of the door is imperforate except for the openings which accommodate the hardware. Accordingly, it could not be unscrewed or otherwise removed since it is welded to the solid block core. In the case of the striker assembly, the striker plate, per se, is screwed to the solid core but, when the door is closed, it is not accessible from the outside.

The above and other features of the invention including various novel details of construction and combinations of parts will now be more particularly described with reference to the accompanying drawings and pointed out in the claims. It will be understood that the particular lock assembly embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1:
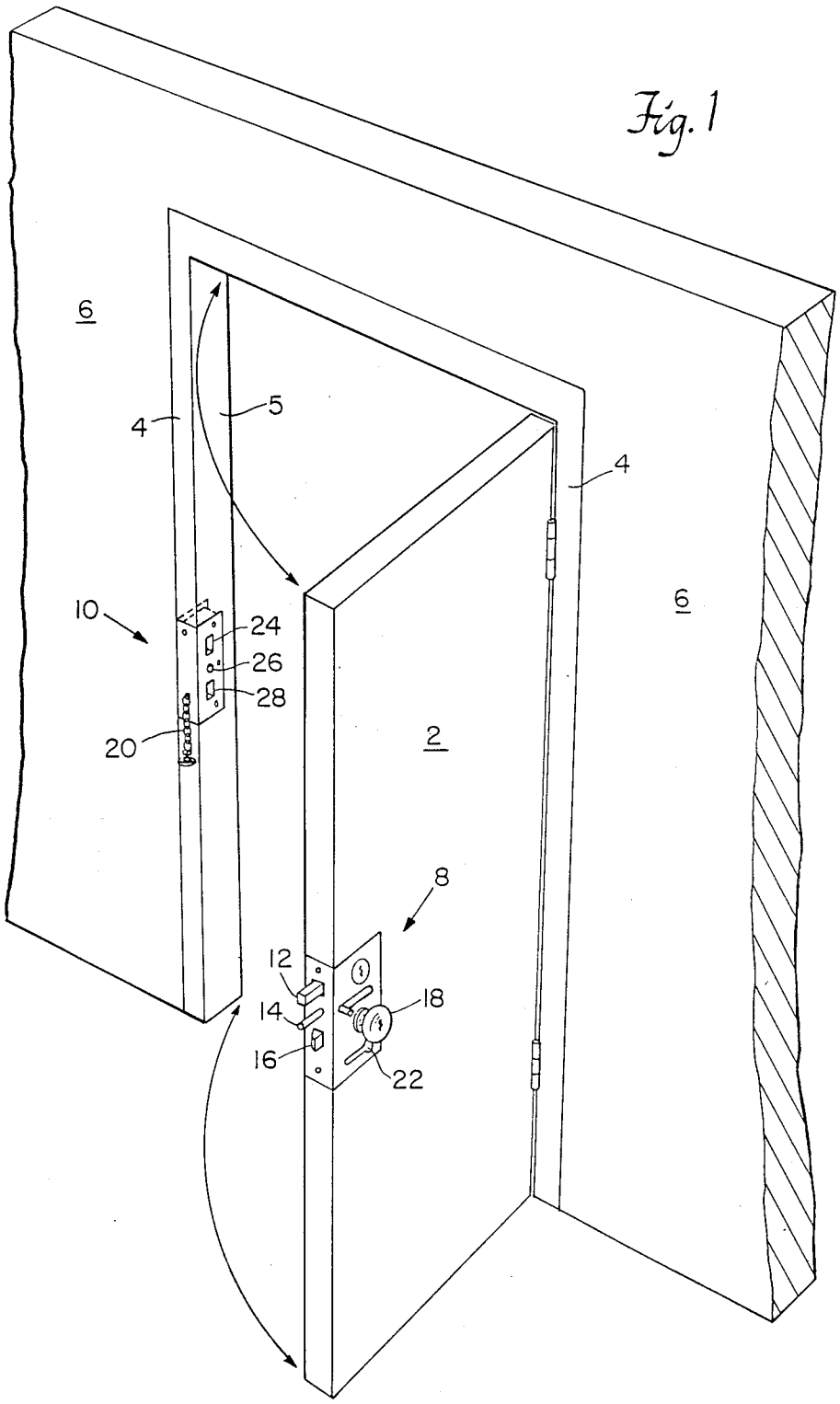
FIG. 1 is a perspective view of a door in open position with a lock mounting assembly embodying the invention in the door and a striker assembly embodying the invention in the door frame.

The invention is embodied in a security lock system which may employ doors, door frames or other equipment closures. FIG. 1 shows such the invention embodied in both a door 2 mounted and a frame 4. The door pivots in the direction of the curved arrows. As viewed in FIG. 1, the inside of the door 2 is seen and consequently, it is the inside of the wall 6 which is viewed, the door opening inwardly.

The lock mounting assembly is generally designated as 8 and the striker plate assembly is generally designated 10. The mechanism 8 provides a single mounting member for a keyed deadbolt 12, a slidebolt 14, a cylinder operated striker 16 employed by a keyed doorknob 18, and a chainlock 20. The chainlock is mounted on the striker plate assembly 10 and engages a slot 22 in the lock mounting assembly 8.

The striker plate assembly 10 includes a rectangular receiving chamber 24 for the deadbolt 12, a circular receiving chamber 26 for the slidebolt 14 and a rectangular receiving chamber 28 for the doorknob striker 16.

It will be understood that the four locks, per se, the deadbolt 12, the slidebolt 14, the doorknob striker lock 16 the chain lock 22, are conventional pieces of hardware which may be obtained from lock supply sources for incorporation into the present lock assemblies.

Figure 2:
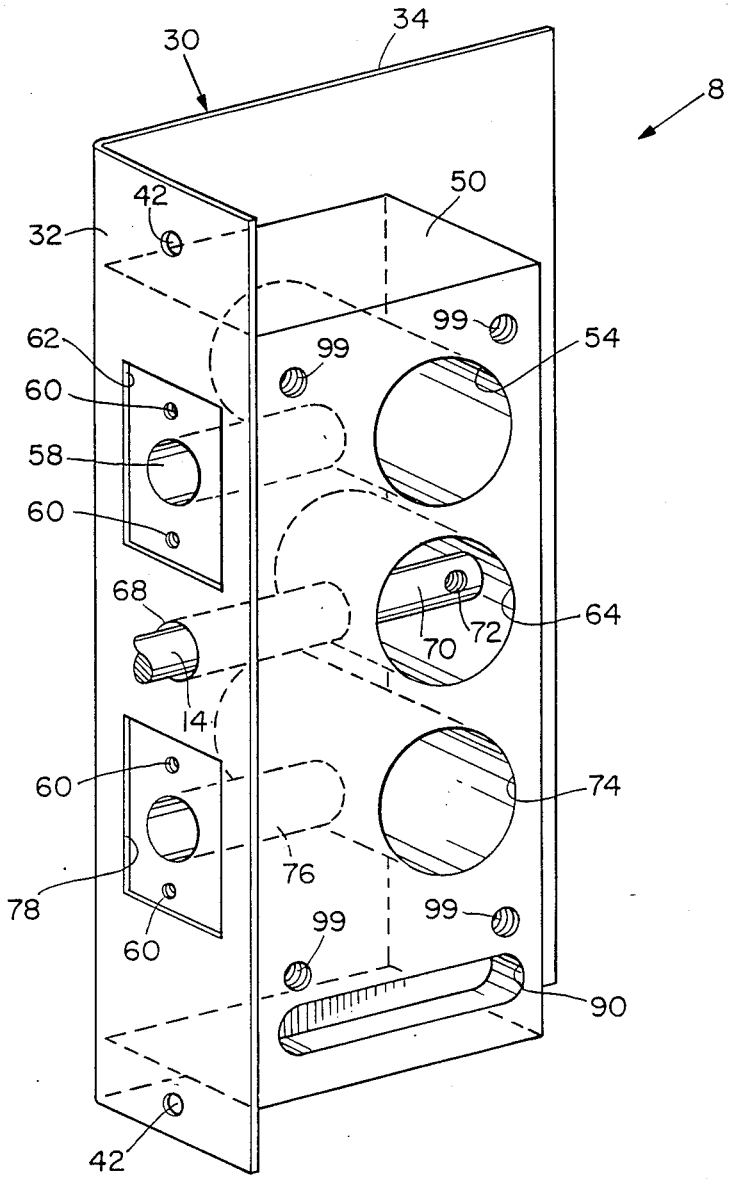
FIG. 2 is a perspective view of a lock hardware mounting assembly embodying the invention.
Figure 3:
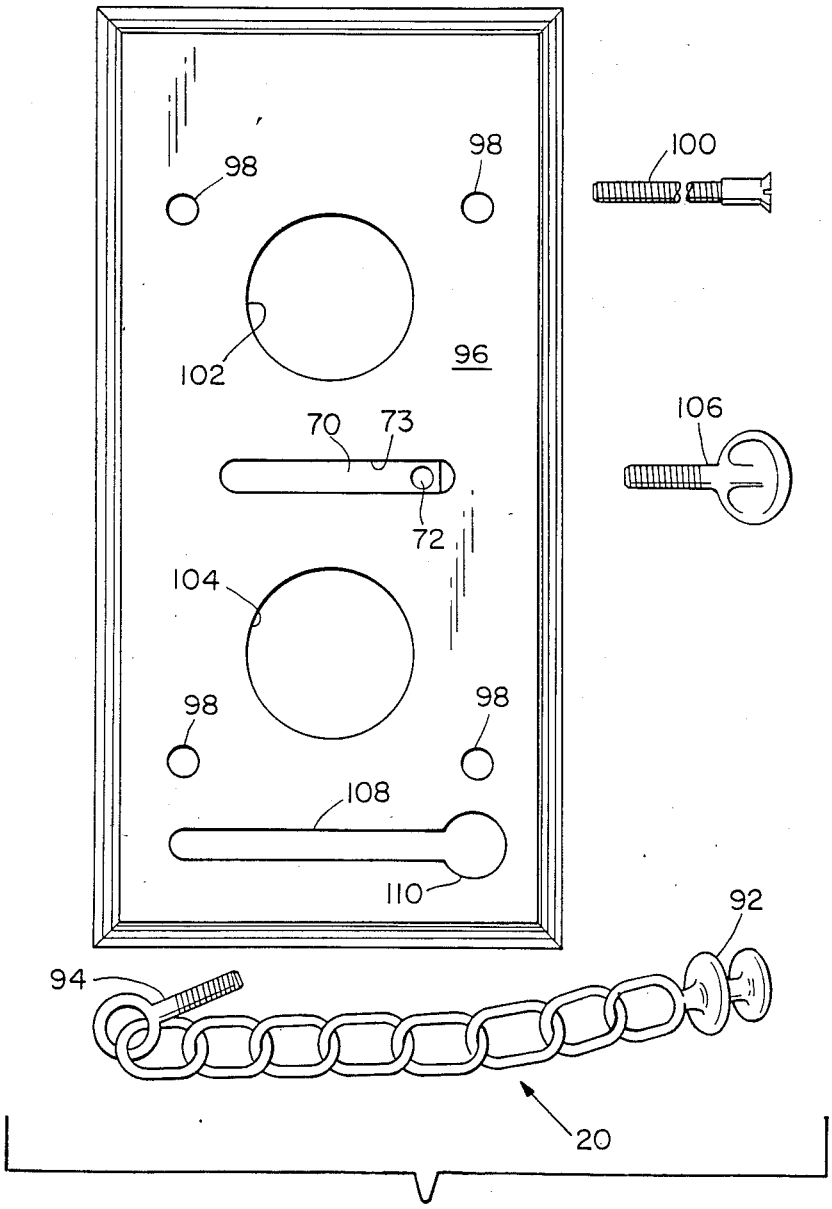
FIG. 3 is an exploded view of the cover plate of the lock mounting assembly and its associated hardwear.
Figure 4:
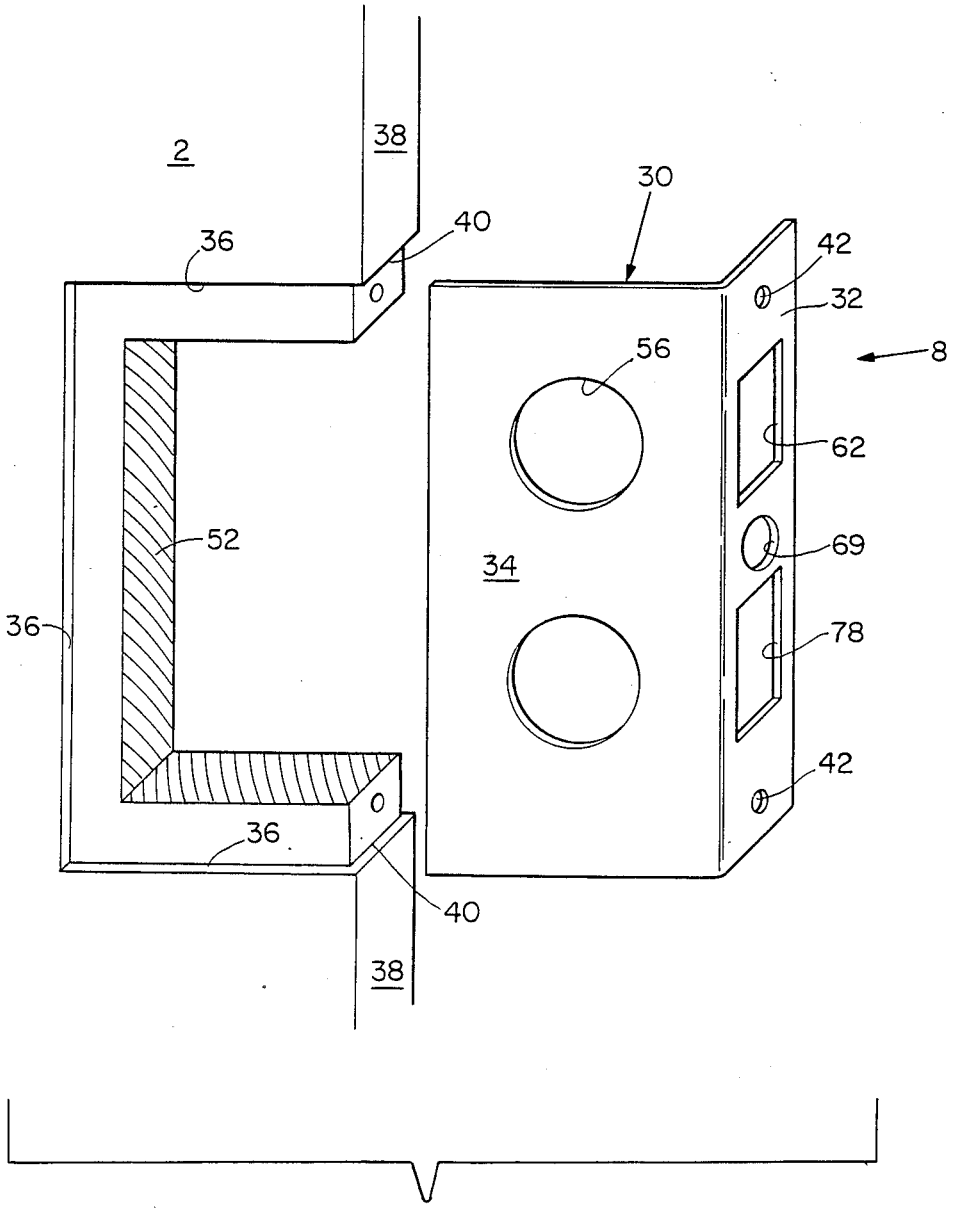
FIG. 4 is an exploded view of the L-shaped member forming part of the lock mounting assembly.

Referring next to FIGS. 2 through 4, the lock mounting assembly 8 will now be described in greater detail. The assembly includes a substantially L-shaped member 30 having a first or vertical edge plate 32, and a second or vertical outer plate 34 forming a right angle therewith. Referring to FIG. 4, the outside of the door 2 is shown rabbeted at 36 to receive the front plate 34, and the edge of the door 38 is rabbeted at 40 to receive the edge plate 32. The edge plate 32 includes holes 42 for receiving screws (not shown) which enter the edge of the door 2 when the L-shaped member 30 is in place.

The L-shaped member 30 is made preferably of stainless steel for both strength and aesthetic appeal, although other metals would also be satisfactory.

Firmly secured as by welding or the like to the inside of the plate 30, is a solid block 50 (FIG. 2), which is preferably made of steel and which forms the core of the assembly. The block is substantially rectangular in shape and is somewhat smaller in area than the front plate 34. Referring again to FIG. 4, the door has a recess or cutout portion 52 to accommodate the core block 50 when the front plate 34 is received in the rabbeted portion 36 of the door and the edge plate 32 is in the rabbeted portion 40 in the edge of the door.

The core block 50 accommodates all of the lock hardware. There is at least one hardwear receiving opening and preferably a plurality thereof in the core block. A first receiving opening in the form of a bore 54 is formed horizontally through the upper portion of the block 50 and aligns with a hole 56 (FIG. 4) in the second or outer plate 34. A conventional keyed deadbolt lock is accommodated in the opening 54 with the bolt 12, per se, extending through a counterbore 58 which opens into the edge of the block. The counterbore 58 is aligned with an opening 62 (FIG. 4) in the first or edge plate 34 of the L-shaped member 30.

Whereas the counterbore 58 is shown cylindrical, it could be square or rectangular in cross section to accommodate a square or rectangular bolt 12 as seen in FIG. 1.

The opening 62 is rectangular and larger than the bore 58 to accept a filler plate (removed for clarity) which would be maintained in the hole 62 by screws (not shown) threaded into holes 60.

The keyed cylinder of the deadbolt would be exposed in the opening 56 (FIG. 4) in the plate 34 (which is the front of the door) and similarly exposed on the inner side of the door as will be explained hereinafter.

A middle, horizontal bore 64 is also formed in the block 50 but does not go completely through the block as does the bore 54. The bore 64 communicates with a transverse bore 68 to accommodate a slidebolt 14 shown in representative fashion by the reference character 70. The slidebolt 14 may have any desired cross-section. The slidebolt is drilled and threaded as shown at 72.

A third horizontal bore 74 is formed in the core block 50 which, in turn, communicates with a passageway 76 opening into the edge of the block, and, hence, with a rectangular opening 78 in the edge face 32 of the L-shape bracket 30. These openings in the block 50 accommodate the cylinder door lock 16 and may include a keyed doorknob 18.

The rectangular opening 78 is similar to the opening 62 described above. Into these openings filler plates (not shown) may be positioned, if desired. As with the deadbolt 12, the striker 16 may be rectangular, square, circular or oval, etc.

At the bottom of the block 50 is an elongate milled slot 90 cut into but not through the core block 50 to accommodate the head 92 (FIG. 3), of the chain lock 20. As seen in FIG. 3, the chain lock 20 includes an eyebolt 94 which is threaded into the striker assembly 8 hereinafter to be described.

Referring next to FIG. 3, there will be seen a third plate comprising a beveled cover plate 96 which has four holes 98 which will align and mate with threaded holes 99 in the core block 50. Screws 100, only one of which is shown, pass through the holes 98 in the plate 96 and are threaded into the holes 99 to secure the plate to the block 50 and against the inner surface of the door 2. The area of the plate 96 is larger than the area of the opening 52 in the door. The inner surface of the door need not necessarily be rabbeted, although it may. The plate 96 engages the door on three sides to assist in mounting the lock mounting mechanism 8 and the screws 100 drawing it firmly in place in the door.

The core plate 96 also includes holes 102 and 104 which will expose the keyed deadbolt hardware and the keyed doorknob 18 respectively.

Between the apertures 102 and 104, is a slot 73 to expose the portion 70 of the slidebolt 14. An operating key 106 may be threaded into the threaded hole 72 in the slidebolt. It is used to move the slidebolt from right to left as viewed in FIG. 3 into the locking position.

At the bottom of the cover plate 96 is a horizontal slot 108 having a circular opening 110 at its right-hand end. This is to accommodate the head 92 of the chain lock 20. When the plate 96 has been assembled to the core block 50, the head 92 is inserted by passing it through the circular opening 110 where upon it may slide toward the left as viewed in FIG. 3 in the slot 90 in the block core 50.

It will be noted from the foregoing that there are no screws or other means for removing the lock mounting mechanism 8 on the outside of the door. When the door is closed, the screws which pass through the holes 42 in the edge plate 32 are not exposed, and the screws 100 holding the plate 96 against the door, are on the inside of the door.

Figure 5:
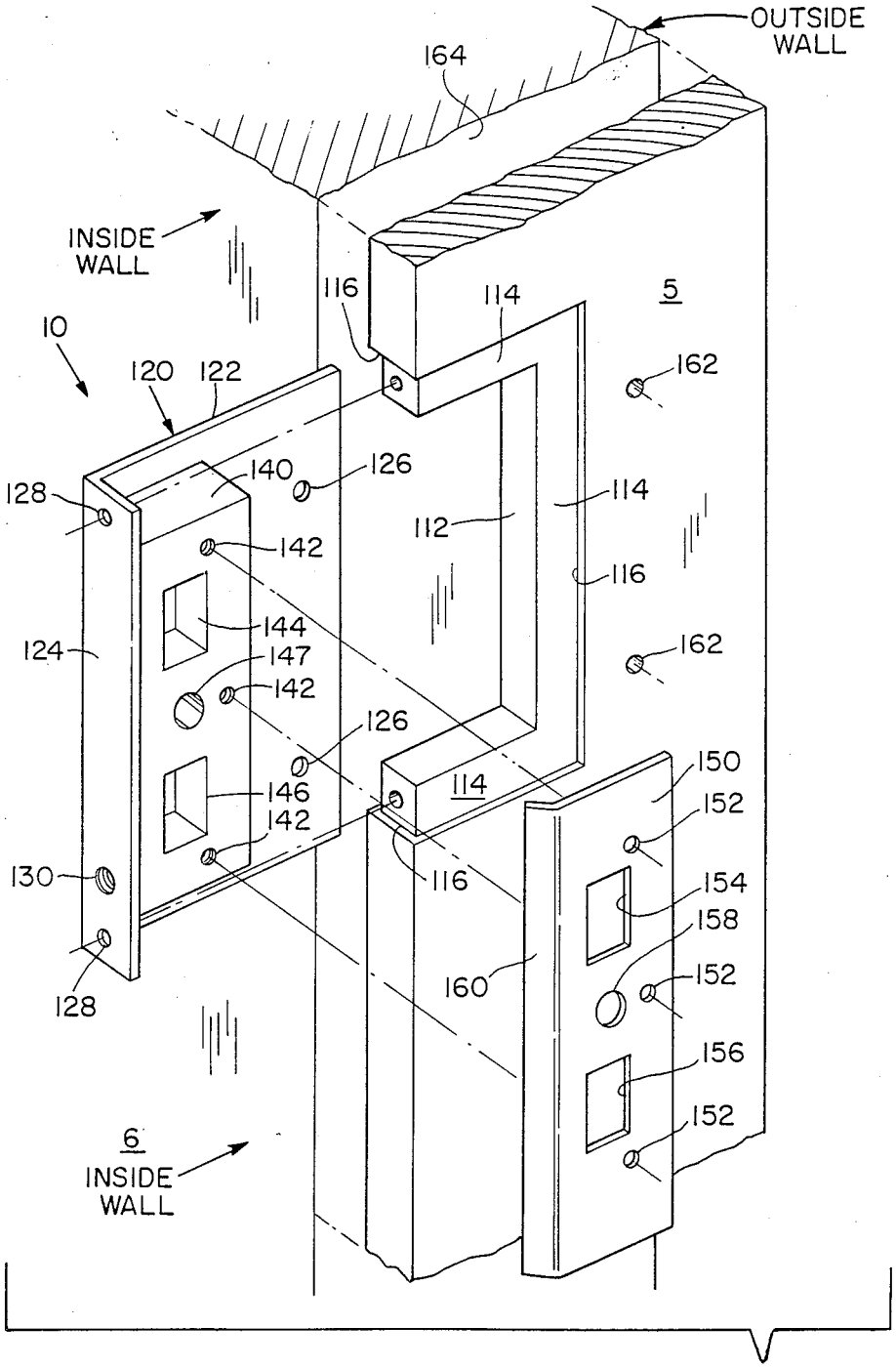
FIG. 5 is an exploded perspective view of the striker assembly.

The striker assembly 10 will now be described with particular reference to FIG. 5. An inside surface 5 of the door frame 4 includes a cutout 112 which extends into but not completely cross the surface 5. The cutout is surrounded by rabbeted portions 114 and 116 on three sides of the door frame.

The striker assembly 10 is constructed in the same manner as the lock assembly mechanism 8. It includes an L-shaped member generally indicated 120 having a first vertical or edge plate 122 and a second vertical or interior plate 124. The edge plate 122 includes holes 126 and the plate 124 includes holes 128 to receive holding screws, (not shown). A threaded opening 130 is formed in the face 124 to receive the eyebolt 94 of the chain lock 20. The L-shaped member 120, like the member 30 of the lock assembly, is made preferably of stainless steel not only for strength but appearance.

Welded to the inner side of the member 120 is a core block 140 preferably made of steel or like material. The core block 140 includes threaded holes 142. It also includes openings 144 and 146, herein illustrated as rectangular, to receive the strikers 12 and 16 of the deadbolt and keyed cylinder doorknob lock. The holes 144 and 146 would be comparable in shape to the cross-section of the strikers 12 and 16. The block 140 also includes a bore 147 to receive the slidebolt 14.

The openings in the core block 140 may either terminate without intersecting the opposite side or may go completely through the plate block. In any event, there is no need for any corresponding openings in the inner plate 120 unless the striker and deadbolt were extremely long.

A third striker plate 150, per se, is provided and is engageable with the block 140. It includes holes 152 which are alignable with the threaded holes 142 in the block 140. Vertical openings 154 and 156 are faced to align with the openings 144 and 146 in the block 150. There is also a circular opening 158 in the striker plate 150 which aligns with the slidebolt opening 147 in the block 140.

The striker plate may include a beveled or camming edge 160 which serves as the first surface to be engaged by the beveled end of the striker of the cylinder doorknob lock 16.

The apparatus is assembled by positioning the inner plate 122 in the rabbeted portions 114 and 116 in the frame member 5 of the door frame 4. Screws are inserted in the holes 128 into the frame member 5 and screws are inserted through the holes 152 into the threaded bores in the block 140 to tighten the striker plate 50 to the core block.

Long screws may, if desired, be inserted in holes 162 in the frame member 5. They would pass through the openings 126 in the inner plate 122 and into a two by four or other interior framing member. These screws could, if desired, be replaced by long nails, but screws are preferable. These screws in cooperation with the screws passing through the holes 128 and 152 hold the striker assembly in the frame.

We claim:

1. A lock assembly comprising:

an L-shaped member having a first plate and a second plate forming a right angle therewith, the first plate being engageable with a vertical edge portion of a door member and the second plate engageable with a portion of a door member normal to the edge portion.

a solid, one piece, metal block permanently secured to the inside of the L-shaped member and forming an integral solid core thereof, the solid block core being engageable within a recess in the door member.

a third plate, substantially parallel to the second plate and releasably secured to the solid block core, a plurality of cylindrical bores passing through the one piece metal block to accommodate lock operating hardware, the axes of the bores being parallel to each other and normal to the second plate, a transverse bore associated with and intersecting each cylindrical bore and passing through the one piece metal block to accommodate a slideable locking element, the axes of the transverse bores being parallel to each other and normal to the first plate, and a slot in the solid block extending parallel to the cylindrical bores to receive a head of a chain lock.

2. A lock hardware-mounting assembly comprising:

an L-shaped member having an edge plate and a front plate forming a right angle therewith, the edge plate being engageable with the edge of a door and the front plate being engageable with the front of the door, a solid, one piece, metal block permanently secured to the inside of the L-shaped member and forming an integral solid block core thereof, the solid block core being receivable within a recess in the edge of the door, a cover plate engageable with the inside of the door and releasably secured to the solid block core, a plurality of cylindrical bores passing through the one piece metal block to accommodate lock operating hardware, the axes of the bores being parallel to each other and normal to the front plate, a transverse bore associated with and intersecting each cylindrical bore and passing through the one piece metal block to accommodate a slideable locking element, the axes of the transverse bores being parallel to each other and normal to the edge plate, and a slot in the solid block extending parallel to the cylindrical bores to receive a head of a chain lock;

3. An assembly according to claim 2 wherein fasteners pass through the cover plate and are received in holes in the solid block core.

4. An assembly according to claim 1 wherein the solid block core is metal and welded to the second plate.

5. An assembly according to claim 2 wherein the solid block core is metal and welded to the second plate.

6. An assembly according to claim 2 wherein the cover plate is secured to the metal block core by screws which draw the cover plate against the door in which it is mounted.

7. An assembly according to claim 2 wherein the front plate is imperforate except for openings which accommodate lock hardware.

* * * * *